United States Patent [19]

Pratt

[11] Patent Number: 4,771,721

[45] Date of Patent: Sep. 20, 1988

[54] SUBMARINE PERISCOPE SYSTEMS

[75] Inventor: Stanley J. Pratt, Glasgow, Scotland

[73] Assignee: Barr & Stroud Limited, Glasgow, Scotland

[21] Appl. No.: 108,876

[22] Filed: Oct. 15, 1987

[30] Foreign Application Priority Data

Oct. 25, 1986 [GB] United Kingdom ..... 8625601

[51] Int. Cl.[4] ..... B63G 8/00

[52] U.S. Cl. ..... 114/340

[58] Field of Search ..... 114/340, 312; 434/26; 343/710, 714; 350/540, 544

[56] References Cited

U.S. PATENT DOCUMENTS 2,173,192 9/1939 Williams ..... 114/340

4,300,468 11/1981 Catano et al. ..... 114/340

*Primary Examiner*—Sherman D. Basinger

*Assistant Examiner*—Edwin L. Swinehart

*Attorney, Agent, or Firm*—Pennie & Edmonds

[57] ABSTRACT

A submarine periscope of the non-hull penetrating type has an extendable hoist (11) secured at one end to the submarine hull (2) and at its other end carries a sensor pod (8). Pod (8) is rotatable by a motor (13) carried by the hoist (11) and is electrically connected to sensory-signal output devices (34,35) inside the hull (2) by a flexible cable (24) penetrating hull (2) at a gland (21) to which is fitted a rotatable signal transmission device (19). Cable (24) terminates at slip rings (32) secured to the transmission device (19) inside the hull (2). The transmission device (19) is rotatable by a motor (29) and motors (13,29) are both controlled by a controller (30) arranged to provide for synchronous rotation of pod (8) and device (19).

6 Claims, 1 Drawing Sheet

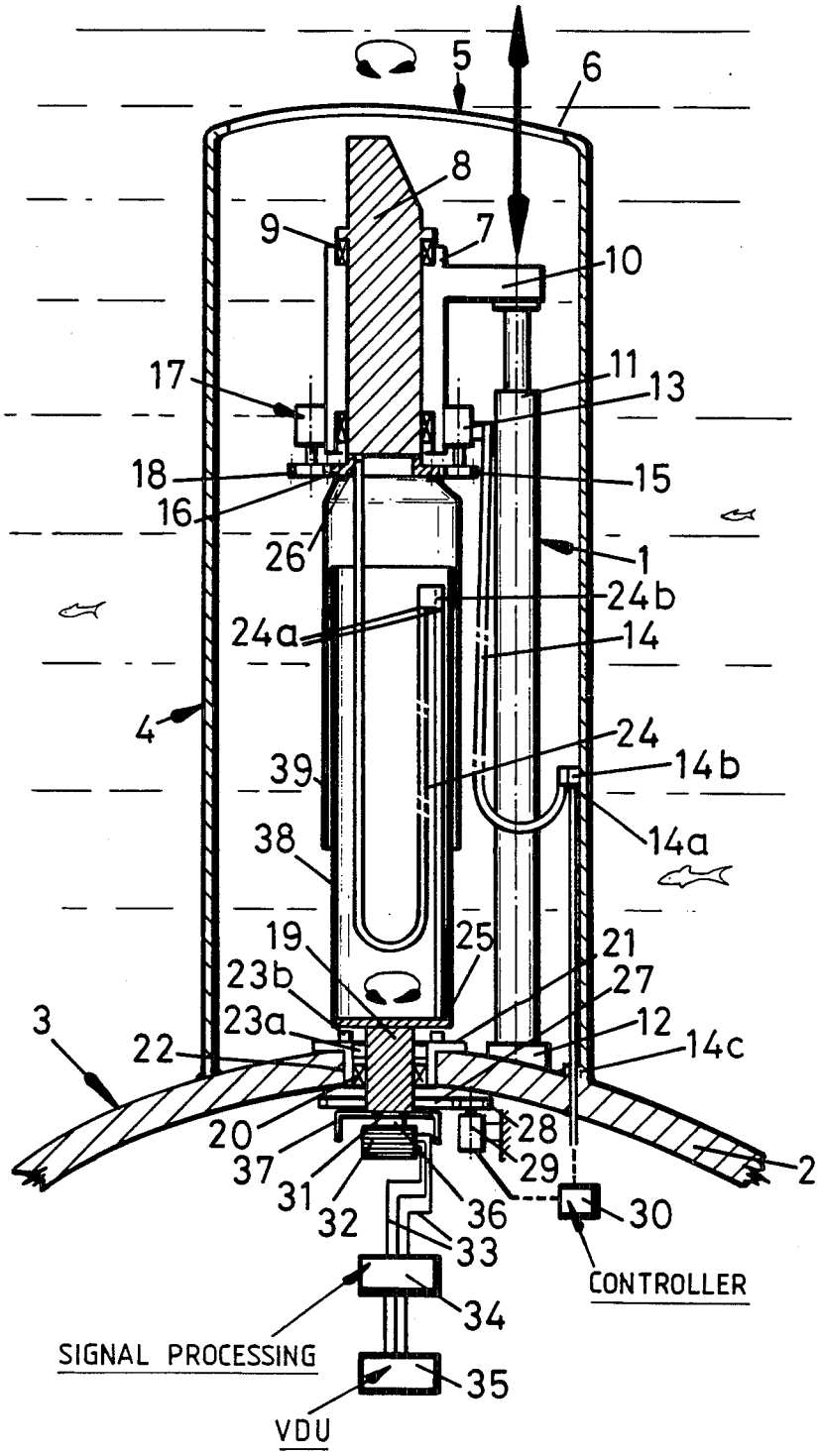
5
6
8
9
7
10
17
11
13
18
15
16
26
1
24b
24a
14
4
24
39
14b
14a
38
19
25
21
23b
27
3
23a
12
22
14c
20
28
37
29
2
31
36
30
32
33
CONTROLLER
34
SIGNAL PROCESSING
35
VDU

SUBMARINE PERISCOPE SYSTEMS

This invention relates to submarine periscope systems.

Submarine periscope masts are well known and are fitted to submarines primarily for the purpose of permitting various observations including diverse sensor measurements to be taken above the water level during such times as the submarine is submerged close below the water level and is subjected to water pressure in the range O atmosphere to X atmosphere (where X is a design factor for the submarine) whilst only the uppermost portion or head of the mast projects above the water level.

In conventional periscope systems there is provided a complete full length sealed outer casing housing at its distal end various observation and sensor instruments and possibly also communications equipment, which are mounted at the distal end of a sealed rotatable mast in which are enclosed the sensitive electrical and optical components of the instruments and equipment. A simple gland seal is provided between the main hull and the casing to prevent water ingress therebetween whilst permitting extension and retraction of the mast. If any water does pass the gland it can be readily removed without any danger of penetrating to the mast interior. Since the full length of the periscope mast through two or more decks due to the unitary form of construction employed and to protect the integrity of its internal environment, it occupies a relatively large amount of the limited interior space of the submarine.

It has now been found that substantial improvements in operating efficiency and/or space utilization can be attained by dispensing with the major part of the mast and using a sealed sensor pod for observation and sensor measurements, which pod is connected by flexible cable means to a remote signal transmission device.

The present invention provides a submarine periscope comprising a mast head mounting a sealed sensor pod means, a hoisting means disposable in use outside the main watertight body of a submarine hull for raising and lowering the sensor pod means relative to the hull, a first rotary drive mounted on said hoisting device for rotating said sensor pod means, a signal transmission device rotatably mountable in an opening in the hull and provided with hull gland means for providing a rotational seal between said device and the hull, said device being provided with an annular wall means below said gland means for keeping any water passing said gland in use of the periscope away from a lower part of the device having rotary sensor signal transmission connector means for connection to sensor signal output means, said device having drivingly connectable thereto second rotary drive means disposable in use of the periscope for rotation of the device relative to the hull, said device being connected to said sensor pod by flexible cable mean for transmission of sensor signals therebetween, and rotary drive control means formed and arranged for synchronising rotation of said sensor pod means and said signal transmission device.

With a periscope of the present invention a number of problems associated with the use of a large unitary mast are avoided. On the one hand the major bulk of the mast is dispensed with avoiding the need for accommodation thereof within the hull thereby leaving additional space for other uses. On the other hand the mass and inertia are substantially reduced resulting in more rapid deployment and operation thereof.

Preferably an upper part of the signal transmission device is provided with "static" sealing means for watertight clamping thereof to the hull gland at a selected water pressure related to the operational water pressure limit for the sensor pod.

Further preferred features and advantages of the invention will appear from the following detailed description given by way of example of a preferred embodiment illustrated with reference to the accompanying drawing in which:

FIG. 1 is a general schematic vertical section of a periscope of the invention illustrating its mounting on a submarine.

FIG. 1 shows a periscope mast 1 mounted on the hull 2 of a submarine 3 inside a fin housing 4 which has an opening 5 in its upper end 6 through which the upper end 7 of the periscope mast 1 is extendable for observation purposes.

In more detail, the mast head 7 comprises a sealed sensor pod 8 rotatably supported at 9 on the telescopically extendable arm 10 of a hoisting device 11 which is mounted at 12 on the hull 2. The arm 10 mounts a drive motor 13, conveniently electrically or hydraulically operated, provided with a flexible power supply cable 14 and having a spur gear wheel 15 which drivingly engages a gear wheel 16 mounted at the base of the sensor pod 8 for rotation of the sensor pod. A position sensor means 17 is also mounted on the arm 10 with a spur gear 18 drivingly engaged with the gear wheel 16 of the sensor pod for monitoring the angular position of the sensor pod 8 for the purposes of controlling sensor pod rotation and/or monitoring the direction of observation.

A remote signal transmission device 19 is mounted rotatably at 20 inside a conventional hull gland 21 within a hull opening 22. The gland 21 is provided with conventional rotary and static sealing means 23*a*, 23*b* which are operable to seal the hull gland 21 at a predetermined water pressure related to the operational water pressure limit for the sensor pod 8.

The transmission device 19 is connected to the sensor pod by a flexible cable means 24 through static waterproof joints 25, 26. Similar joint 14*a*, 24*a* are provided between the respective cable means 14, 24 and associated junction boxes 14*b*, 24*b* and also 14*c* between the sensor pod drive motor power supply cable 14 and the hull 2.

Inside the hull 2 the transmission device 19 has fixedly connected thereto a gear wheel 27 which is drivingly engaged by the spur gear 28 of a drive motor 29. The motor 29 is connected to a control means 30 to which is also connected the sensor pod drive motor 13 so as to ensure synchronous rotation of the sensor pod 8 and the transmission device 19. Desirably one of the motors 13, 29 is "slaved" to the other.

At its lower end 31, the transmission device 19 is provided with a connector 32 for transmission lines 33 of output signals from the sensor pod 8 to suitable processing and display means 34, 35.

The connector 32 includes suitable connection means 36 as required such as slip rings for electrical signal transmission and Sivers (Trade Name) joint means for microwave signal transmission, as well as service connections such as high pressure air rotating coupling means for transmitting a pressurized air flow to a sensor cooling means. The connection means 36 are protected from any water passing the rotary seal 23*a*, by means of an annular wall means 37.

In order to protect the sensor pod cable 24 against possible fouling and/or damage during raising and lowering of the sensor pod 8, there are desirably provided mutually telescoping housing elements 38, 39 mounted on respective ones ofthe signal transmission device 19 and the sensor pod 8. The former housing element 38 also supports the sensor pod cable junction box 24*b*.

In use of the periscope mast at operational depths, the sensor pod 8 is raised by the hoist device 10, 11 and can be freely rotated without restriction in either direction. As may be seen from the drawing the mass of both the telescopically extendable and rotating parts are considerably reduced as compared with conventional masts thereby facilitating a more rapid response and also having considerably lower drive and power operating requirements. In this connection it will also be appreciated that in a conventional periscope system extension and retraction requires significant frictional forces between the periscope mast and hull gland seals to be overcome whilst in the case of the present invention these frictional resistance is avoided.

Yet another advantage is the avoidance of water being positively drawn into the hull interior as occurs in conventional systems when the periscope mast is drawn back into the hull interior from the wet external environment. A still further advantage is that the connection means 36 are disposed inside the main hull thereby facilitating maintenance thereof.

What is claimed is:

1. A periscope for a submarine having a hull comprising a mast head mounting a sealed sensor pod means, a hoisting means disposable in use outside the main watertight body of the submarine hull for raising and lowering the sensor pod means relative to the hull, a first rotary drive mounted on said hoisting means for rotating said sensor pod means, a signal transmission device rotatably mountable in an opening in the hull and provided with hull gland means for providing a rotational seal between said device and the hull, said device being provided with an annular wall means below said gland means for keeping any water passing said gland in use of the periscope away from a lower part of the device which carries a rotary sensor signal transmission connector means for connection to sensor signal output means, said device having drivingly connectable thereto second rotary drive means disposable in use of the periscope for rotation of the device relative to the hull, said device being connected to said sensor pod by flexible cable means for transmission of sensor signals therebetween, and rotary drive control means formed and arranged for synchronising rotation of said sensor pod means and said signal transmission device.

2. A submarine periscope as claimed in claim 1, wherein an upper part of the signal transmission device is provided with static sealing means for water-tight sealing thereof to the hull gland at a selected water pressure related to the operational water pressure limit for the sensor pod.

3. A submarine periscope as claimed in claim 1, wherein each of said first and second rotary drive means comprises an electric motor driven in common by said drive control means, one of said electric motors being slaved to the other electric motor.

4. A submarine periscope as claimed in claim 1, wherein said flexible cable means is encased in telescoping housing elements of which one element is connected to the pod means and the other element is connected to the transmission device.

5. A submarine periscope as claimed in claim 1, wherein said hoisting means comprises a hydraulic ram.

6. A submarine periscope as claimed in claim 1, wherein a fin housing mounted on the hull forms a protective tube around the mast head when the hoisting means are in a retracted condition.

* * * * *